US010577988B2

(12) United States Patent
Hoglund et al.

(10) Patent No.: US 10,577,988 B2
(45) Date of Patent: Mar. 3, 2020

(54) ACTUATOR FOR AXIAL DISPLACEMENT OF AN OBJECT

(71) Applicant: FREEVALVE AB, Angelholm (SE)

(72) Inventors: Anders Hoglund, Munka Ljungby (SE); Urban Carlson, Helsingborg (SE)

(73) Assignee: FREEVALVE AB, Angelholm (SE)

( * ) Notice: Subject to any disclaimer, the term of this patent is extended or adjusted under 35 U.S.C. 154(b) by 67 days.

(21) Appl. No.: 15/566,993

(22) PCT Filed: Apr. 15, 2016

(86) PCT No.: PCT/SE2016/050326
§ 371 (c)(1),
(2) Date: Oct. 16, 2017

(87) PCT Pub. No.: WO2016/167715
PCT Pub. Date: Oct. 20, 2016

(65) Prior Publication Data

US 2018/0119583 A1 May 3, 2018

(30) Foreign Application Priority Data

Apr. 16, 2015 (SE) ..... 1550461

(51) Int. Cl.
*F01L 9/02* (2006.01)
*F01B 21/02* (2006.01)

(52) U.S. Cl.
CPC ..... *F01L 9/026* (2013.01); *F01B 21/02* (2013.01)

(58) Field of Classification Search
CPC ..... F01L 9/026; F01L 9/02; F01L 9/04; F01L 9/025; F15B 21/12
See application file for complete search history.

(56) References Cited

U.S. PATENT DOCUMENTS

| | | | |
|---|---|---|---|
| 3,727,595 A | 4/1973 | Links | |
| 8,973,541 B2 | 3/2015 | Hedman | |
| 9,885,261 B2 * | 2/2018 | Hoglund | F01L 13/0036 |

FOREIGN PATENT DOCUMENTS

| | | |
|---|---|---|
| DE | 1151702 B | 7/1963 |
| WO | 03/102386 A1 | 12/2003 |
| WO | 2015/005856 A1 | 1/2015 |

OTHER PUBLICATIONS

International Search Report, dated Jul. 26, 2016, from corresponding PCT application No. PCT/SE2016/050326.

* cited by examiner

*Primary Examiner* — Abiy Teka
(74) *Attorney, Agent, or Firm* — Young & Thompson

(57) ABSTRACT

Disclosed is an actuator including a cylinder volume having a first portion, and an actuator piston disc displaceable in the cylinder between inactive and active positions, an inlet channel between a pressure fluid inlet and the first portion of the cylinder volume, a first inlet valve body in the inlet channel, an outlet channel between the first portion of the cylinder volume and a pressure fluid outlet, and an outlet valve body in the outlet channel. The slave piston is displaceable in a bore between inactive and active positions. The first inlet valve body includes a seat valve body having an inactive position closing the inlet channel, the slave piston, in moving from inactive to active positions, rams the first inlet valve body, displacing it to an active position at which the inlet channel is open, the outlet valve body being connected to and jointly displaceable with the slave piston.

19 Claims, 5 Drawing Sheets

ACTUATOR FOR AXIAL DISPLACEMENT OF AN OBJECT

TECHNICAL FIELD OF THE INVENTION

The present invention relates to an actuator for axial displacement of an object. The present invention is specifically useful in applications having high demands for high speeds and precise controllability of the axial displaceability. The present invention relates specifically to a gas exchange valve actuator for internal combustion engines, in which the actuator is suggested to be used for driving one or more inlet valves or outlet valve controlling the supply and evacuation, respectively, of air relative to the cylinders of the internal combustion engine. Thus, the inventive actuator is especially suitable for driving engine valves and thereby eliminates the need for one or more cam shafts in the internal combustion engine.

The inventive actuator comprises an actuator piston disc and a cylinder volume, the actuator piston disc separating said cylinder volume in a first portion and a second portion and is in axial direction displaceable back and forth in said cylinder volume between an inactive position and an active position. The actuator further comprises an inlet channel extending between a pressure fluid inlet and the first portion of the cylinder volume, a first inlet valve body arranged in said inlet channel, an outlet channel extending between the first portion of the cylinder volume and a pressure fluid outlet, and an outlet valve body arranged in said outlet channel.

BACKGROUND OF THE INVENTION AND PRIOR ART

Thus, an actuator, commonly known as a pneumatic actuator, comprises an actuator piston disc that is displaceable in axial direction between a first position (inactive position) and a second position (active/extended position). The displacement is achieved by controlling a supply of pressure fluid, such as pressurized gas/air, that acts on and drives the actuator piston disc. The actuator piston disc acts in its turn directly or indirectly on the object that is to be displaced, for example an engine valve, for controlling its position.

In the application having an engine valve, when the actuator piston disc is in the inactive position the engine valve is in contact with its seat, and when the actuator piston disc is in the active position the engine valve is open, i.e. located at a distance from its seat.

In known actuators the inlet valve body is as a rule constituted by a slide valve body that is driven by an electro magnet. In for instance U.S. Pat. No. 8,973,541 it is disclosed that a first inlet valve and an outlet valve are connected to each other and constitute part of one and the same slide valve body, wherein the slide valve body is either driven directly by the electro member or the electro member controls the slide valve body indirectly via an unspecified and indefinite "pilot-slave" arrangement, which is not at all described in said document. However, it is plausible that such a "pilot-slave-arrangement" embrace that the electro member displaces a "pilot" that indirectly drive the slide valve body being a "slave" by the electro member/pilot controls the supply of a pressure fluid acting on and displaces the slide valve body, as is shown in for instance U.S. Pat. No. 3,727,595.

One drawback of the disclosed design having the first inlet valve and the second inlet valve combined in one and the same slide valve body, is that the slide valve body has great mass that counteract fast acceleration in connection with the actuator is given instruction regarding change of operational condition, from inactive to active. In other words the change over time from closed inlet channel to fully open inlet channel is unnecessarily long, and the initial movement of the slide valve body when the inlet channel is to be opened is the slowest which is the opposite to the wanted. Thereto, a so-called draught will occur when the seat valve body is in motion from the first position to the second position. Draught entail that the inlet is open at the same time as the outlet is still open, leading to the pressure fluid passing straight through the actuator without performing any useful work. The only way to prevent draught in the disclosed design, in which a common slide valve body is used, is to not open the inlet channel when the slide valve body starts to move until after the outlet channel has been closed, that entail unnecessary long displacement of the slide valve body which takes time and consumes unnecessary amounts of pressure fluid.

The greatest problem is that it always takes place a certain leakage of pressure fluid past the slide valve body which also entails increased consumption of pressure fluid performing no useful work. All consumption of pressure fluid is directly connected to the energy consumption of the actuator and thereby it is central to keep the consumption to a minimum.

OBJECT OF THE INVENTION

The present invention aims at obviating the above-mentioned drawbacks and shortcomings of previously known actuators for axial displacement of an object and to provide an improved actuator. A basic object of the invention is to provide an improved actuator of the initially defined type that decrease the change over time from closed to fully open inlet channel as well as reducing the consumption of pressure fluid.

Another object of the present invention is to provide an actuator that entirely eliminates leakage of pressure fluid when the actuator is in the inactive state.

BRIEF DESCRIPTION OF THE INVENTION

According to the invention at least the basic object is achieved by way of initially defined actuator, which has the features defined in the independent claim. Preferred embodiments of the present invention are further defined in the dependent claims.

According to a first aspect of the present invention an actuator of the initially defined type is provided, which is characterized in that the actuator comprises a slave piston that is displaceable back and forth in a bore between an inactive position and an active position, and in that the first inlet valve body is constituted by a seat valve body having an inactive position at which the inlet channel is closed, the slave piston being configured to during its movement from the inactive position to the active position ram said first inlet valve body and displace it to an active position at which the inlet channel is open, the outlet valve body being connected to and jointly displaceable with the slave piston.

Thus, the present invention is based on the insight that when the actuator is given instruction regarding change of operational state from an inactive state to an active state, in order to displace an object, a slave piston is used to ram the first inlet valve body. Thus, the slave piston is put in motion and has a considerable velocity when it hits/ram the first inlet valve body, which immediately will be displaced from its inactive position (closed position) to its fully open active position. This entails that when the object, which the actuator is configured to displace, is about to accelerate from stand still the inlet channel is immediately fully open and maximal pressure fluid flow may flow into the first portion of the cylinder volume during the entire displacement of the actuator piston disc in the cylinder volume.

By using a seat valve body as the first inlet valve body it is secured that no leakage of pressure fluid takes place when the actuator is in the inactive state, i.e. when the first inlet valve body is closed.

According to a preferred embodiment of the present invention, the actuator comprises a second inlet valve body arranged in said inlet channel, the second inlet valve body being rigidly connected to the actuator piston disc and jointly displaceable with the actuator piston disc between an inactive position and an active position. The second inlet valve body is configured to close the inlet channel when the actuator piston disc is located at least at a predetermined distance from its inactive position, i.e. a direct correlation between the pressure pulse length and the displacement of the actuator piston disc/object is obtained.

According to a preferred embodiment the actuator further comprises an electrically controlled pilot valve configured to communicate a control pressure to the slave piston via a control pressure channel, the pilot valve being configured to place itself in a resting state, in which the control pressure channel is in fluid communication with a control fluid outlet of the pilot valve, and in an active state, in which the control pressure channel is in fluid communication with the control fluid inlet, respectively.

Further advantages of and features of the invention are evident from the other dependent claims and from the following detailed description of preferred embodiments.

BRIEF DESCRIPTION OF THE DRAWINGS

A more complete understanding of the abovementioned and other features and advantages of the present invention will be evident from the following detailed description of preferred embodiments with reference to the enclosed drawings, in which.

DETAILED DESCRIPTION OF PREFERRED EMBODIMENTS

Figure 1:
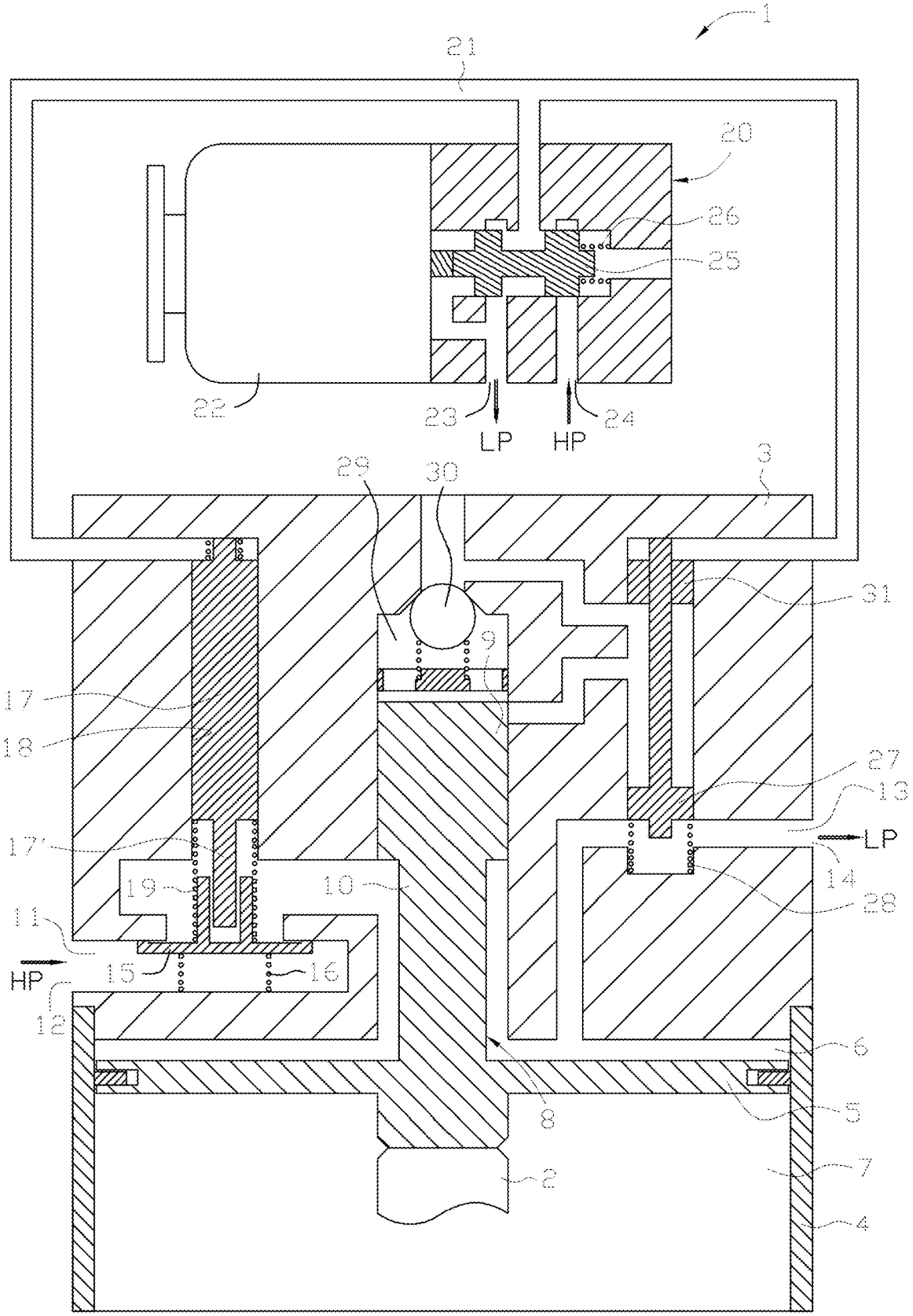
FIG. 1 is a schematic illustration of an inventive actuator according to a first embodiment, where the actuator is in an inactive state.
Figure 2:
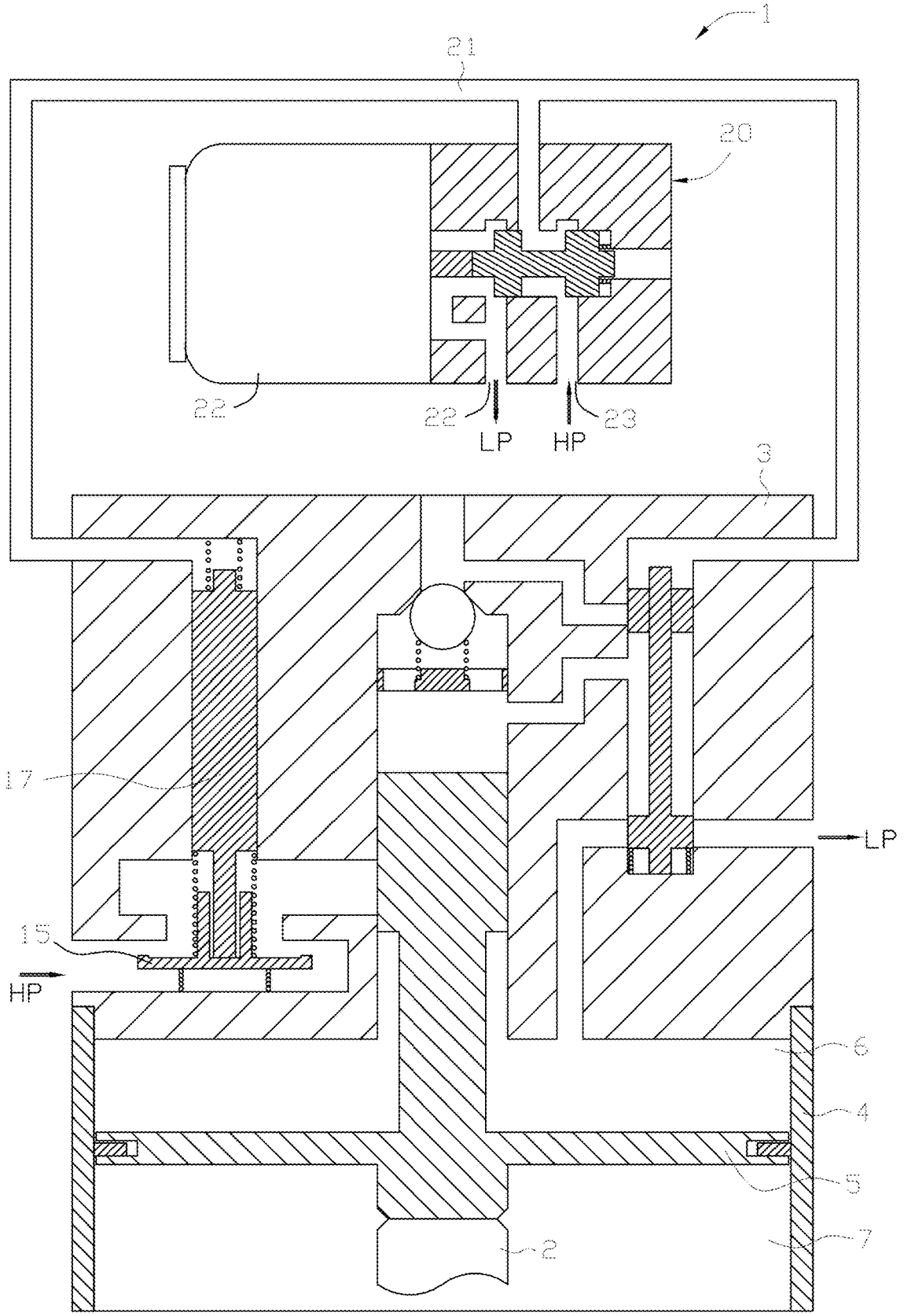
FIG. 2 is a schematic illustration of the actuator according to FIG. 1, where the actuator is in an active state.

Reference is initially made to the FIGS. 1 and 2, which disclose a first embodiment of the inventive actuator, as well as disclosing the basic inventive idea separated from other members. The present invention relates to an actuator, generally designated 1, for axial displacement of an object, such as an actuator 1 for axial displacement of a gas exchange valve 2 of an internal combustion engine. Herein below the invention will be described in an exemplifying but not to a limiting purpose with reference to an application in which the actuator 1 is used for driving one or more inlet valves or outlet valves 2 in an internal combustion engine.

In the shown embodiment, the actuator 1 comprises an actuator housing 3, a cylinder 4 delimiting a cylinder volume or chamber, an actuator piston disc 5 that is arranged in and that in axial direction is displaceable back and forth in said cylinder volume between an inactive resting position (FIG. 1) and an active position/lower dead centre (FIG. 2). The actuator piston disc 5 separates said cylinder volume in a first upper portion 6 and a second lower portion 7. The valve shaft of the gas exchange valve 2 ends in the second portion 7 of the cylinder volume, and the gas exchange valve 2 is biased in a direction upward by means of a conventional valve spring or gas spring (not shown). The actuator piston disc 5 returns to its inactive position by being biased, preferably by way of spring means, in a direction upwards in the figures. The spring means may be a mechanical spring or gas spring located in the second portion 7 of the cylinder volume. In the event the actuator piston is connected to and drives an inlet or outlet valve of an internal combustion engine the spring may be constituted by a valve spring that lifts the gas exchange valve to its closed position. However, alternative solutions to realize the biasing are conceivable within the scope of the present invention.

The actuator 1 further comprises an actuator piston rod, generally denoted 8, which is rigidly connected to and axially extending from the actuator piston disc 5, and which together with the actuator piston disc forms an actuator piston. The actuator piston rod 8 eliminates the risk for a skew setting of the actuator piston disc 5. The actuator piston rod 8 has in the shown embodiment a first thicker portion 9, which is located at a distance from the actuator piston disc 5 and is in a tight fit with a bore in the actuator housing 3, and a second thinner portion 10 extending between and connecting the thicker portion 9 and the actuator piston disc 5. In this embodiment, the thicker portion 9 constitutes a second inlet valve body that will be described herein below.

The actuator 1 also comprises a pressure fluid circuit, preferably a pneumatic, configured for a controllable supply of a gas or gas mixture, for example air, to the first portion 6 of the cylinder volume to generate a displacement of the actuator piston disc 5 from the inactive position to the active position, and configured for controllable evacuation of the gas or gas mixture from the first portion 6 of the cylinder volume to generate a return movement of the actuator piston disc 5 from the active position to the inactive position.

The pressure fluid circuit comprises an inlet channel 11 extending between a pressure fluid inlet 12 in the actuator housing 3 and the first portion 6 of the cylinder volume, and an outlet channel 13 extending between the first portion 6 of the cylinder volume and a pressure fluid outlet 14 in the actuator housing 3. Said inlet channel 11 is via the pressure fluid inlet 12 connected to a pressure fluid source (HP), and said outlet channel 13 is via the pressure fluid outlet 14 connected to a pressure fluid sink (LP). In other words the pressure fluid inlet 12 of the actuator 1 is configured to be connected to the pressure fluid source (HP), and the pressure fluid outlet 14 is configured to be connected to the pressure fluid sink (LP). The pressure fluid source may be a compressor that belongs to the internal combustion engine and with or without a belonging tank, or only a pressure tank. The pressure fluid sink may be any point with a lower pressure than the one generated in the pressure fluid source, for example a conduit leading back to the compressor. The pressure fluid circuit is preferably a closed system with a raised return pressure, i.e. the pressure fluid sink (LP) has for example a pressure of 4-6 Bar, and the pressure fluid source has for example a pressure of 15-25 Bar.

The actuator 1 comprises a first inlet valve body 15 arranged in said inlet channel 11 for controlling the flow of pressure fluid in the inlet channel 11 past the position where the first inlet valve body 15 is situated, i.e. arranged to open and close, respectively, the inlet channel 11. Thus, the inlet channel 11 is closed when the first inlet valve body 15 is located in its inactive position and opened when the first inlet valve body 15 is located in its active position. It is essential for the present invention that the first inlet valve body 15 is constituted by a seat valve body, thereby a geometrically well defined inactive position for the inlet valve body 15 is obtained as well as the inlet channel 11 being free from leakage past the first inlet valve body 15 when it is located in its inactive position. The inlet valve body 15 is preferably biased by way of a spring 16 in one the inlet channel 11 closing direction.

The actuator comprises a slave piston 17 that is displaceable back and forth in a bore 18 in the actuator housing 3 between an inactive position and an active position, the slave piston 17 being configured to during its movement from the inactive position to the active position ram the first inlet valve body 15 and displace it to its active position where the inlet channel 11 is open. The term ram is meant that the slave piston 17 is in movement when it hits the inlet valve body 15 that is standing still and that is thereby put in movement. After the ramming the slave piston 17 drives the inlet valve body 15 to and keeps it in its active position. Directly after the slave piston 17 has struck open/rammed the inlet valve body 15 it is preferred that the inlet valve body 15 obtains a higher velocity than the slave piston 17 and thereby a faster opening of the inlet channel 11 is obtained. The slave piston 17 then hunts down the first inlet valve body 15. A spring 19 is located between the slave piston 17 and the first inlet valve body 15, whereupon the inlet valve body 15 contribute to return and keep the slave piston 17 in its inactive position when the inlet valve body 15 closes the inlet channel 11. Thereto, also pressure fluid located in the inlet channel 11 acts to return the slave piston 17 when the inlet valve body 15 closes.

Preferably the end of the slave piston 17 that is configured to ram the first inlet valve body 15 comprises an axially extending pin 17', that is arranged in telescopic relation relative to a sleeve/recess 15' of the first inlet valve body 15. It shall be pointed out that the inverted relationship may occur, i.e. that the slave piston 17 comprises a sleeve or recess and the first inlet valve body 15 comprises a pin. This design entails elimination of the risk of skew setting of the first inlet valve body 15.

In the disclosed embodiment, the actuator comprises an electrically controlled pilot valve 20, also known as multi-way valve, which is configured to communicate a control pressure to the slave piston 17 via a control pressure channel 21. By electrically controlled means controlled by way of an electro magnetic device, such as a solenoid 22, by way of a piezo electric device, etc. Thus, the control pressure channel 21 extends from the pilot valve 20 to the end of the slave piston 17 that is opposite the end of the slave piston 17 configured to ram the inlet valve body 15. The pilot valve 20 is configured to take an inactive state (FIG. 1), in which the control pressure channel 21 is in fluid communication with a control fluid outlet 23 of the pilot valve 20, and an active state (FIG. 2), in which the control pressure channel 21 is in fluid communication with a control fluid inlet 24. The control fluid inlet 24 of the pilot valve 20 is configured to be connected to a pressure fluid source (HP), and the control fluid outlet 23 of the pilot valve 20 is configured to be connected to a pressure fluid sink (LP).

It shall be pointed out that in all drawings the pilot valve 20 is drawn located outside the actuator housing 3, which is fully conceivable, still it is preferable that the pilot valve 20 as well as the control pressure channel 21 are located fully or partly within the actuator housing 3.

In a preferred embodiment, the pilot valve 20 comprises a pilot valve body arrangement 25, which is displaceable back and forth between an inactive position and an active position, whereby the pilot valve body arrangement 25 is biased by way of a spring 26 in a direction toward its inactive position. The solenoid 22 is configured to displace the pilot valve body arrangement 25 in the direction toward its active position when said solenoid 22 is activated. The activation of the solenoid 22 takes place due to a change of state instruction from a control unit of the engine, i.e. an instruction to open the engine valve 2, that in its turn for instance is initiated based on the position of the crank shaft.

The actuator 1 preferably comprises a second inlet valve body that is arranged in said inlet channel 11, and that in the disclosed embodiment is constituted by the thicker portion 9 of the actuator piston rod 8, i.e. the second inlet valve body 9 is rigidly connected to the actuator piston disc 5 and jointly displaceable with the actuator piston disc 5 between an inactive position and an active position, and is arranged to open and close, respectively, the inlet channel 11. The second inlet valve body is configured to admit fluid flow in the inlet channel 11 when the second inlet valve body is located in its inactive position. The second inlet valve body is configured to keep the inlet channel 11 closed when the actuator piston disc 5 is located at least at a predetermined distance from its inactive position.

According to the disclosed embodiment, the first inlet valve body 15 and the second inlet valve body 9 are arranged in series with each other, and preferably the second inlet valve body 9 is arranged between the first inlet valve body 15 and the first portion 6 of the cylinder volume, since the first inlet valve body 15 provides a better sealing than the second inlet valve body 9, that is constituted by a slide valve body.

The actuator 1 also comprises an outlet valve body 27 arranged in said outlet channel 13 for controlling the flow of pressure fluid in the outlet channel 13 past the position where the outlet valve body 27 is located, i.e. arranged to open and close, respectively, the outlet channel 13. The outlet valve body 27 is in the first embodiment constituted by a slide valve body. The outlet valve body 27 is biased by way of a spring 28 in direction towards its inactive position, in which the outlet channel 13 is open. According to the first embodiment the pilot valve 29 is configured to communicate said control pressure to the outlet valve body 27 via said control pressure channel 21. Thus, the control pressure channel 21 extends from the pilot valve 20 to the end of the outlet valve body 27 that is opposite the end of the outlet valve body 27 against which the spring 28 acts. Thus, the outlet valve body 27 is separated from the slave piston 17 in the first embodiment according to FIGS. 1 and 2. Upon activation of the pilot valve 20, the outlet valve body 27 will entirely or to a great extent close the outlet channel 13 before the slave piston 17 ram and open the first inlet valve body 15. Thereby draught and unnecessary consumption of pressure fluid are prevented.

Figure 3:
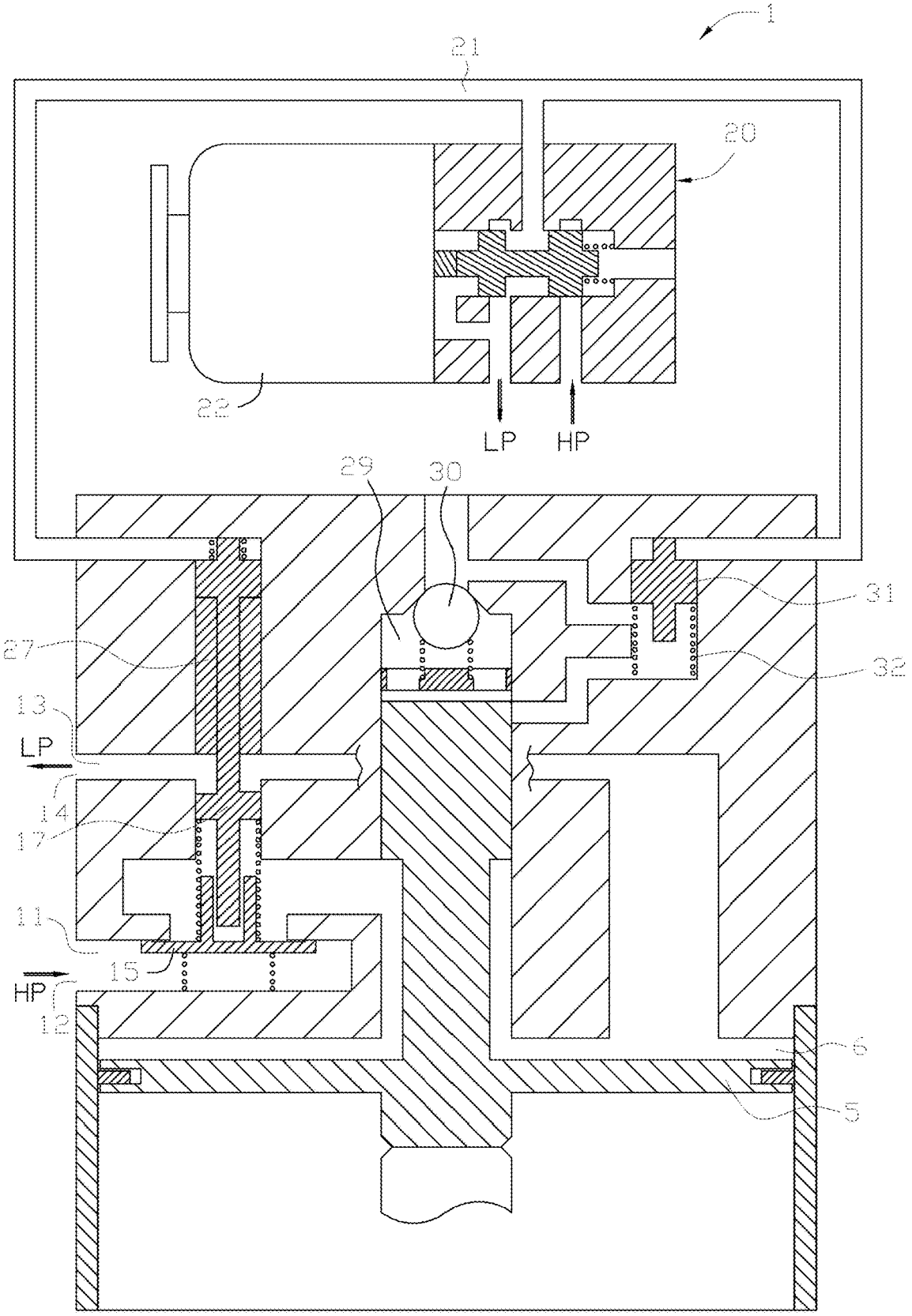
FIG. 3 is a schematic illustration of an inventive actuator according to a second embodiment.

Reference is now made to FIG. 3 disclosing a second embodiment of the inventive actuator 1. Only differences in relation to the other embodiments will be described.

In the second embodiment the outlet valve body 27 is connected to and jointly displaceable with the slave piston 17. This entails that the outlet channel 13 will be entirely or to great extent closed by the outlet valve body 27 before the inlet channel 11 is opened by the first inlet valve body 15. Thereby draught and unnecessary consumption of pressure fluid are prevented. When the outlet valve body 27 is connected to the slave piston 17 no separate spring is needed to bias the outlet valve body 27 towards its inactive position.

The actuator 1 comprises preferably a hydraulic circuit comprising a locking volume 29, a non-return valve 30 and a hydraulic valve, the actuator piston rod 8 being arranged to be displaced in an axial direction relative to said locking volume 29 in connection with axial displacement of the actuator piston disc 5 in the cylinder volume. Liquid (oil) is allowed to flow into the liquid filled locking volume 29 via the non-return valve 30 and out from the locking volume 29 via the hydraulic valve. The hydraulic valve comprises a hydraulic valve body 31, which is displaceable back and forth between an inactive position, in which the locking volume 29 is open, and an active position, in which the locking volume 29 is closed, the hydraulic valve body 31 in the disclosed embodiment being biased by means of a spring 32 in the direction towards its inactive position. In other words, when the actuator piston is displaced from the inactive position (FIG. 1) to the active position (FIG. 2) the actuator piston rod 8 leaves space for inflow of liquid into the locking volume 29 and the hydraulic valve is closed, and when the actuator rod is displaced from the active position to the inactive position the hydraulic valve must first be opened whereupon the liquid is pressed out from the locking volume 29.

According to the second embodiment the pilot valve 20 is configured to communicate said control pressure to the hydraulic valve body 31 via said control pressure channel 21. Thus, the control pressure channel 21 extends from the pilot valve 20 to the end of the hydraulic valve body 31 that is opposite the end of the hydraulic valve body 31 against which the spring 32 acts. Thus, the hydraulic valve body 31 is separated from the slave piston 17 in the second embodiment, according to FIG. 3. It shall be pointed out that in the first embodiment, according to FIGS. 1 and 2, the hydraulic valve body 31 is connected to and jointly displaceable with the outlet valve body 27. When the hydraulic valve body 31 is connected to the outlet valve body 27 in the first embodiment no separate spring is needed to bias the hydraulic valve body 31 towards its inactive position.

It shall be pointed out that the outlet valve body 27 and the hydraulic valve body 31, respectively, have the same functions irrespective of location.

Figure 4:
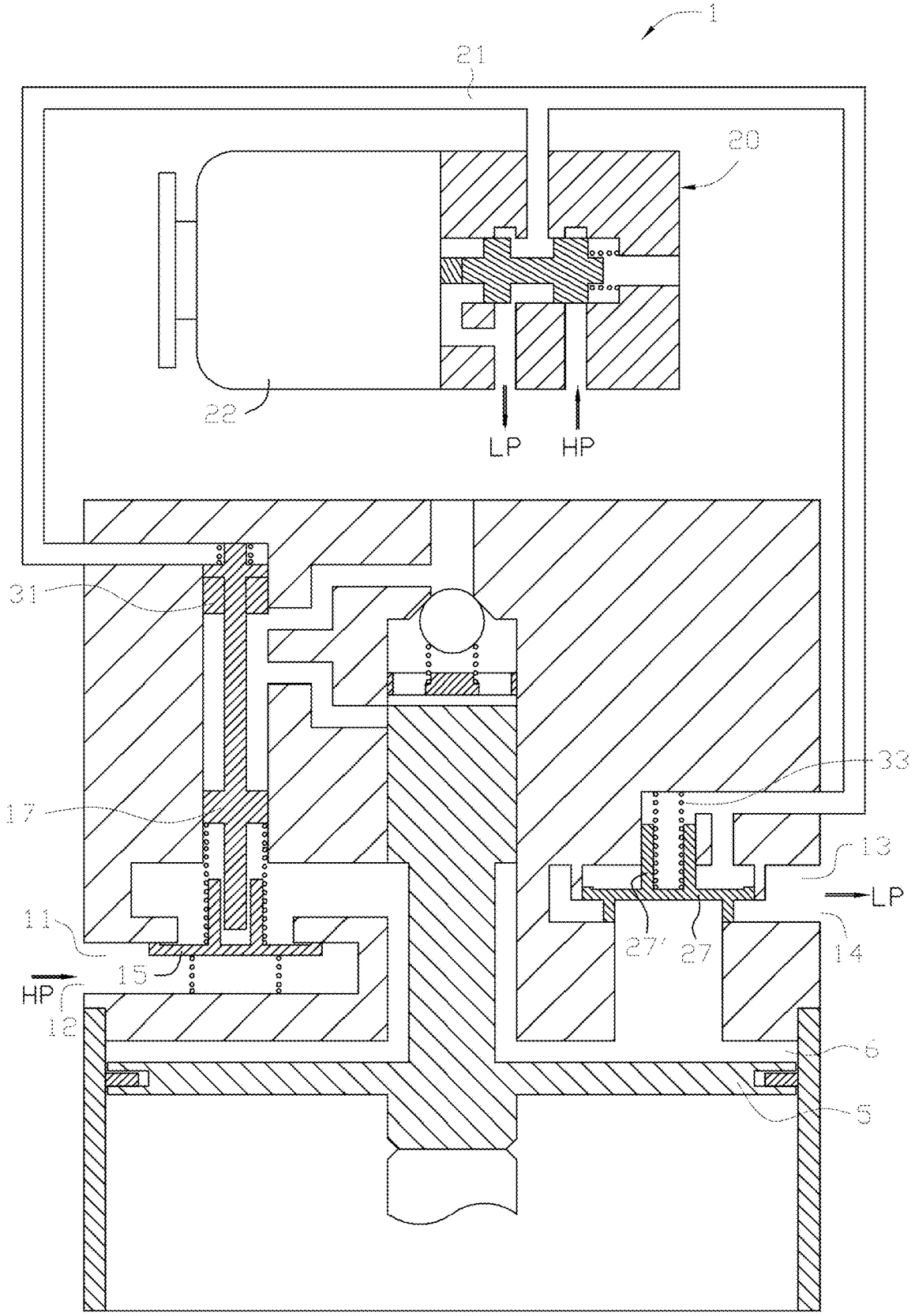
FIG. 4 is a schematic illustration of an inventive actuator according to a third embodiment.

Reference is now made to FIG. 4 disclosing a third embodiment of the inventive actuator 1. Only differences in relation to the other embodiments will be described.

In the third embodiment the outlet valve body 27 is separated from the slave piston 17, and the hydraulic valve body 31 is connected to and jointly displaceable with the slave piston 17. When the hydraulic valve body 31 is connected to the slave piston 17 no separate springs are needed to bias the hydraulic valve body 31 towards its inactive position. The outlet valve body 27 is in the third embodiment constituted by a seat valve body that preferably is biased by means of a spring 33 in one the outlet channel 13 closing direction. The outlet valve body 27 comprises preferably a guide pin 27' for eliminating the risk of skew setting thereof. As in the first embodiment the pilot valve 20 is configured to communicate said control pressure to the outlet valve body 27 via said control pressure channel 21. The mutual relationship between the pressurized areas of the outlet valve body 27 secure correct function.

Figure 5:
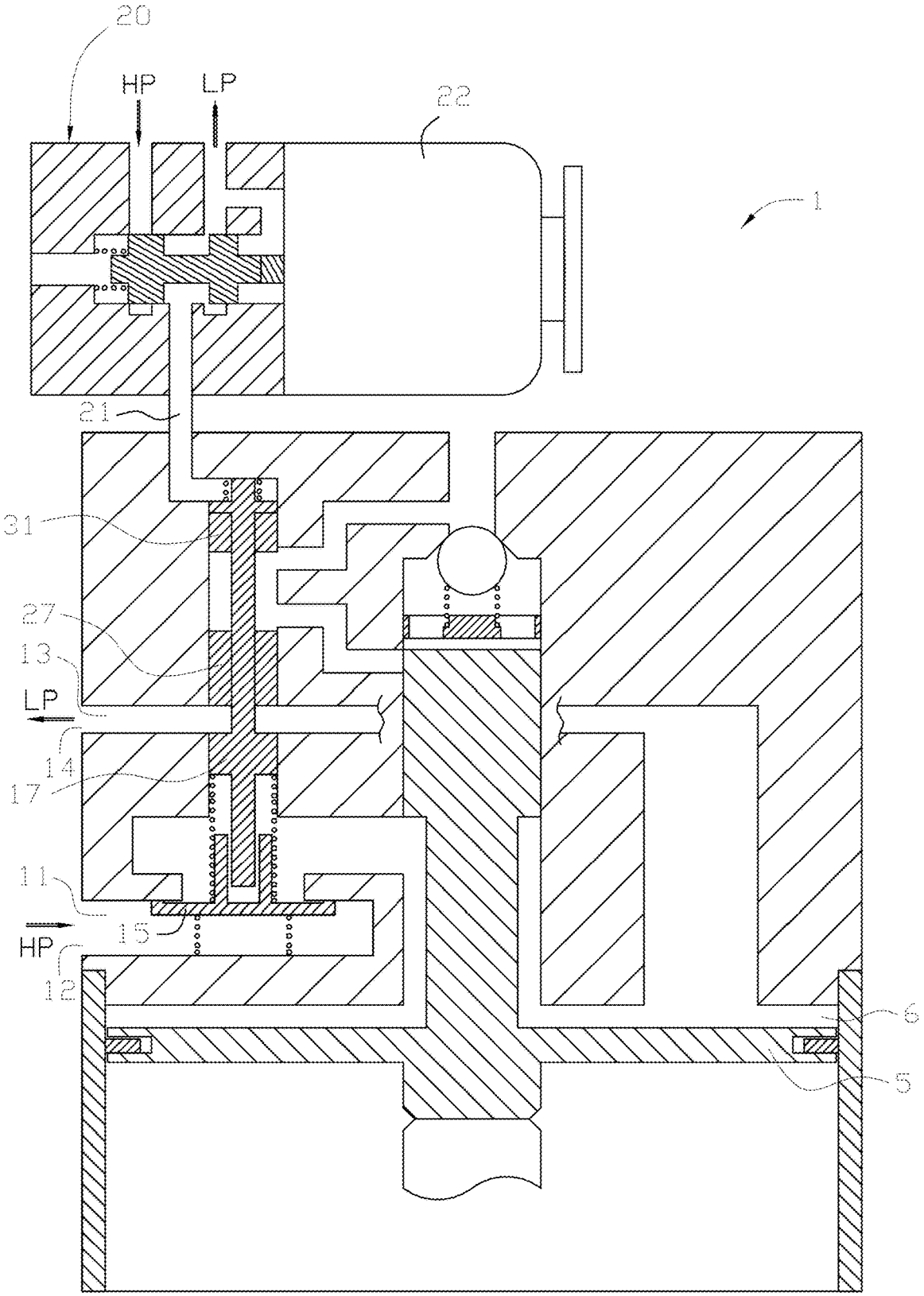
FIG. 5 is a schematic illustration of an inventive actuator according to a forth embodiment.

Reference is now made to FIG. 5 disclosing a forth, most preferred, embodiment of the inventive actuator 1. Only differences in relation to the other embodiments will be described. In the forth embodiment the outlet valve body 27 as well as the hydraulic valve body 31 are connected to and jointly displaceable with the slave piston 17. This embodiment comprises the least number of movable parts.

Herein below the function of the actuator 1 will be described, independently of embodiment if nothing else is mentioned.

In the starting position, the actuator 1 is in its inactive state (see for instance FIG. 1), i.e. the pilot valve 20 is in inactive state and the solenoid 22 is inactivated, and low fluid pressure has effect in the control pressure channel 21. The first inlet valve body 15 is in closed position, the actuator piston disc 5 is in the inactive position/upper dead centre and the second inlet valve body 9 is in open position, the outlet valve body 27 is either in open or closed position depending on the embodiment, and the hydraulic valve body 31 is open. (See for instance FIG. 1) Thus, the actuator consumes neither power nor pressure fluid in the inactive state.

When a change of state signal/instruction is given by the control unit that the actuator 1 shall perform a displacement of the object/engine valve, the solenoid 22 is activated and the pilot valve 20 change to active state (see FIG. 2). This leads to a high fluid pressure having effect in the control pressure channel 21, whereupon the slave piston 17 and the hydraulic valve body 31 are displaced towards their active positions, at the same time as the outlet valve body 27 is either displaced towards its active position or is secured in its active position depending on the embodiment. When the slave piston 17 has gained speed the slave piston 17 ram the inlet valve body 15, which quickly is displaced towards its active position and immediately opens the inlet channel 11.

When the inlet channel 11 is open the pressure fluid starts to flow into the first portion 6 of the cylinder volume from the pressure fluid source (HP) via the inlet channel 11, and pressure fluid having high pressure acts against the upper side of the actuator piston disc 5 and displaces the actuator piston in a downward direction. Liquid is sucked into the locking volume 29 past the non-return valve 30 when the actuator piston rod 8 is displaced downwards. The outlet valve body 27 is kept closed. When the actuator piston disc 5 has been displaced a predetermined distance the second inlet valve 9 cuts off the pressure fluid flow in the inlet channel 11, i.e. prevents a continued inflow of pressure fluid from the pressure fluid source (HP) to the first portion 6 of the cylinder volume. When the supply of pressure fluid from the pressure fluid source (HP) is cut off, the actuator piston disc 5 continues its displacement a distance during the expansion of the pressure fluid in the first portion 6 of the cylinder volume.

When actuator piston disc 5 has reached its active position/lower dead centre, the actuator piston disc 5 is locked (kept in place) as a result of the liquid in the locking volume 29 not being allowed to evacuate.

When the object/engine valve 2 shall start its return movement the solenoid 22 is deactivated, whereupon the pilot valve 20 takes its inactive state, and low fluid pressure has effect in the control pressure channel 21. The slave piston 17 is now allowed to be displaced to its inactive position, whereupon the first inlet valve body 15 closes the inlet channel 11 and contributes to return the slave piston 17, the hydraulic valve body 31 is opened to allow evacuation of liquid from the locking volume 29, the outlet valve body 27 opens the outlet channel 13, and the actuator piston disc 5 can be displaced upwards to the inactive position by means of the spring member.

Feasible Modifications of the Invention

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and the equipment may be modified in all kinds of ways within the scope of the appended claims.

It shall also be pointed out that all information about/concerning terms such as above, below, upper, lower, etc., shall be understood/read with the equipment oriented in accordance with the figures, having the drawings oriented in such a way that the indexing can be read in a correct way. Thus, similar terms indicate only mutual relationships in the shown embodiments, which relationships can be changed if the equipment according to the invention is provided with another construction/design.

It shall be pointed out that even if it is not explicitly stated that a feature from a specific embodiment can be combined with the features in another embodiment, this shall be considered obvious when possible.

The invention claimed is:

1. An actuator for axial displacement of an object, the actuator comprising:

an actuator piston disc (5);

a cylinder volume, wherein the actuator piston disc (5) separates said cylinder volume in a first portion (6) and a second portion (7) and is displaceable in an axial direction back and forth inside in said cylinder volume between an actuator piston inactive position and an actuator piston active position;

an inlet channel (11) extending between a pressure fluid inlet (12) and the first portion (6) of the cylinder volume;

a first inlet valve body (15) arranged in said inlet channel (11), the first inlet valve body (15) being constituted by a seat valve body having a valve body inactive position at which the inlet channel (11) is closed;

an outlet channel (13) extending between the first portion (6) of the cylinder volume and a pressure fluid outlet (14);

an outlet valve body (27) arranged in said outlet channel (13); and a slave piston (17) that is displaceable back and forth in a bore (18) between a slave piston inactive position and a slave piston active position, wherein the slave piston (17) is configured to, during movement from the slave piston inactive position to the slave piston active position, ram said first inlet valve body (15) and displace said first inlet valve body (15) to a valve body active position at which the inlet channel (11) is open, wherein the outlet valve body (27) is connected to and jointly displaceable with the slave piston (17), and wherein a first side of the seat valve body is biased by a spring (16) that biases said seat valve body in a closing direction toward the valve body inactive position.

2. The actuator according to claim 1, wherein the actuator (1) comprises a second inlet valve body (9) arranged in said inlet channel (11), the second inlet valve body (9) being rigidly connected to the actuator piston disc (5) and jointly displaceable with the actuator piston disc (5) between a second inlet valve body inactive position and a second inlet valve body active position.

3. The actuator according to claim 2, wherein an actuator piston rod (8) is rigidly connected to and axially extending from the actuator piston disc (5), and together with the actuator piston disc (5) form an actuator piston, said second inlet valve body (9) constituting part of said actuator piston rod (8).

4. The actuator according to claim 3, wherein the actuator comprises a hydraulic circuit, which comprises a locking volume (29), a non-return valve (30) and a hydraulic valve, and wherein the actuator piston rod (8) is arranged to be displaced in the axial direction relative to said locking volume (29) in connection with axial displacement of the actuator piston disc (5) in the cylinder volume.

5. The actuator according to claim 4, wherein the hydraulic valve comprises a hydraulic valve body (31) which is displaceable back and forth between a hydraulic valve body inactive position, in which the locking volume (29) is open, and a hydraulic valve body active position, in which the locking volume (29) is closed.

6. The actuator according to claim 5, wherein the hydraulic valve body (31) and the outlet valve body (27) are connected to and jointly displaceable with the slave piston (17).

7. The actuator according to claim 3, wherein the second inlet valve body (9) is configured to admit fluid flow in the inlet channel (11) when the second inlet valve body (9) is located in the second inlet valve body inactive position.

8. The actuator according to claim 2, wherein the second inlet valve body (9) is configured to admit fluid flow in the inlet channel (11) when the second inlet valve body (9) is located in the second inlet valve body inactive position.

9. The actuator according to claim 8, wherein the second inlet valve body (9) is configured to prevent fluid flow in the inlet channel (11) when the second inlet valve body (9) is located at least a predetermined distance from the second inlet valve body inactive position.

10. The actuator according to claim 2, wherein the first inlet valve body (15) and the second inlet valve body (9) are arranged in series with each other in said inlet channel (11).

11. The actuator according to claim 10, wherein the second inlet valve body (9) is arranged between the first inlet valve body (15) and the first portion (6) of the cylinder volume.

12. The actuator according to claim 1, wherein the pressure fluid inlet (12) is configured to be connected to a pressure fluid source (HP), and wherein the pressure fluid outlet (14) is configured to be connected to a pressure fluid sink (LP).

13. The actuator according to claim 1, wherein the actuator comprises an electrically controlled pilot valve (20) configured to communicate a control pressure to the slave piston (17) via a control pressure channel (21), the pilot valve (20) being configured to place itself in a resting state, in which the control pressure channel (21) is in fluid communication with a control fluid outlet (23) of the pilot valve (20), and in an active state, in which the control pressure channel (21) is in fluid communication with the control fluid inlet (24), respectively.

14. The actuator according to claim 13, wherein the control fluid inlet (24) of the pilot valve (20) is configured to be connected to a pressure fluid source (HP), and wherein the pressure fluid outlet (23) of the pilot valve (20) is configured to be connected to a pressure fluid sink (LP).

15. The actuator according to claim 13, wherein the pilot valve (20) comprises a pilot valve body arrangement (25), which is displaceable back and forth between a pilot valve body inactive position and a pilot valve body active position, the pilot valve body arrangement (25) being biased by means of a spring (26) in a direction towards the pilot valve body inactive position.

16. The actuator according to claim 15, wherein the pilot valve (20) comprises a solenoid (22), which is configured to displace the pilot valve body arrangement (25) in a direction toward the pilot valve body active position upon activation of said solenoid (22).

17. The actuator according to claim 13, wherein the pilot valve (20) is configured to communicate said control pressure to the outlet valve body (27) via said control pressure channel (21).

18. An actuator for axial displacement of an object, the actuator comprising:

an actuator piston disc (5);

a cylinder volume, wherein the actuator piston disc (5) separates said cylinder volume in a first portion (6) and a second portion (7) and is displaceable in an axial direction back and forth inside said cylinder volume between an actuator piston inactive position and an actuator piston active position;

an inlet channel (11) extending between a pressure fluid inlet (12) and the first portion (6) of the cylinder volume;

a first inlet valve body (15) arranged in said inlet channel (11), the first inlet valve body (15) being constituted by a seat valve body having a valve body inactive position at which the inlet channel (11) is closed;

an outlet channel (13) extending between the first portion (6) of the cylinder volume and a pressure fluid outlet (14);

an outlet valve body (27) arranged in said outlet channel (13); and a slave piston (17) that is displaceable back and forth in a bore (18) between a slave piston inactive position and a slave piston active position, wherein the slave piston (17) is configured to, during movement from the slave piston inactive position to the slave piston active position, ram said first inlet valve body (15) and displace said first inlet valve body (15) to a valve body active position at which the inlet channel (11) is open, wherein the outlet valve body (27) is connected to and jointly displaceable with the slave piston (17), wherein the seat valve body has a first side and an opposite second side, wherein a spring (16) biases the first side of the seat valve body in a closing directions toward the valve body inactive position, and wherein the slave piston (17) is positioned so that during movement of the slave piston (17), from the slave piston inactive position to the slave piston active position, the slave piston (17) rams the second side of said seat valve body to displace said first inlet valve body (15) to the valve body active position at which the inlet channel (11) is open.

19. An actuator for axial displacement of an object, the actuator comprising:

an actuator piston disc (5);

a cylinder volume, wherein the actuator piston disc (5) separates said cylinder volume in a first portion (6) and a second portion (7) and is displaceable in an axial direction back and forth inside said cylinder volume between an actuator piston inactive position and an actuator piston active position;

an inlet channel (11) extending between a pressure fluid inlet (12) and the first portion (6) of the cylinder volume;

a first inlet valve body (15) arranged in said inlet channel (11), the first inlet valve body (15) being constituted by a seat valve body having a valve body inactive position at which the inlet channel (11) is closed;

an outlet channel (13) extending between the first portion (6) of the cylinder volume and a pressure fluid outlet (14);

an outlet valve body (27) arranged in said outlet channel (13); and a slave piston (17) that is displaceable back and forth in a bore (18) between a slave piston inactive position and a slave piston active position, wherein the slave piston (17) is configured to, during movement from the slave piston inactive position to the slave piston active position, ram said first inlet valve body (15) and displace said first inlet valve body (15) to a valve body active position at which the inlet channel (11) is open, wherein the outlet valve body (27) is connected to and jointly displaceable with the slave piston (17), wherein the seat valve body has a first side and an opposite second side, wherein a spring (16) biases the first side of the seat valve body in a closing direction toward the valve body inactive position, wherein the slave piston (17) is positioned so that during movement of the slave piston (17), from the slave piston inactive position to the slave piston active position, the slave piston (17) rams the second side of said seat valve body to displace said first inlet valve body (15) to the valve body active position at which the inlet channel (11) is open, and wherein when the slave piston (17) is in the slave piston inactive position, an end part of the slave piston (17) is spaced from a portion of the second side of said seat valve body, and when the slave piston (17) is in the slave piston active position, the end part of the slave piston (17) is in contact with the portion of the second side of said seat valve body.

* * * * *